United States Patent [19]

McQueston et al.

[11] 4,222,335

[45] Sep. 16, 1980

[54] MEANS FOR MANUFACTURING A MODULAR RAILWAY CAR

[75] Inventors: James C. McQueston, Warminster; Horace P. Bauer, Huntingdon Valley, both of Pa.

[73] Assignee: The Budd Company, Troy, Mich.

[21] Appl. No.: 935,769

[22] Filed: Aug. 22, 1978

[51] Int. Cl.[2] ..... B23P 17/00

[52] U.S. Cl. ..... 105/397

[58] Field of Search ..... 105/397, 401, 379, 378, 105/358, 393; 296/26; 29/428

[56] References Cited

U.S. PATENT DOCUMENTS

| | | | |
|---|---|---|---|
| 3,475,809 | 11/1969 | Brown | 105/358 |
| 3,479,724 | 11/1969 | Krvizenca et al. | 105/358 |
| 3,487,532 | 1/1970 | Phillips | 105/358 |

*Primary Examiner*—Richard A. Bertsch

*Attorney, Agent, or Firm*—A. L. Trueax, Jr.

[57] ABSTRACT

A modular railway car comprises components adapted to be built in different lengths to form different lengths of cars without major changes in the overall design. Sideframes includes sections each including one of a plurality of uniformly spaced windows. The floor and roof include uniformly spaced transverse beams, with a predetermined number of the beams corresponding to the section length between the windows.

5 Claims, 13 Drawing Figures

FIG. 6
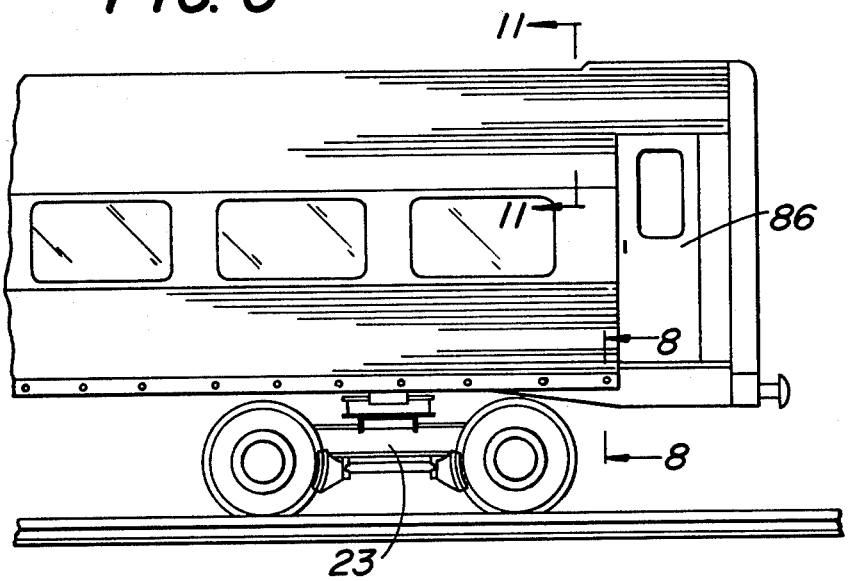
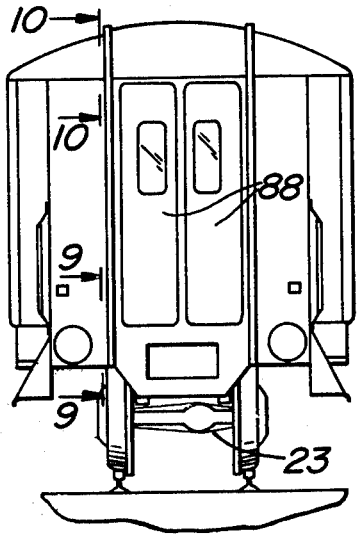
FIG. 7

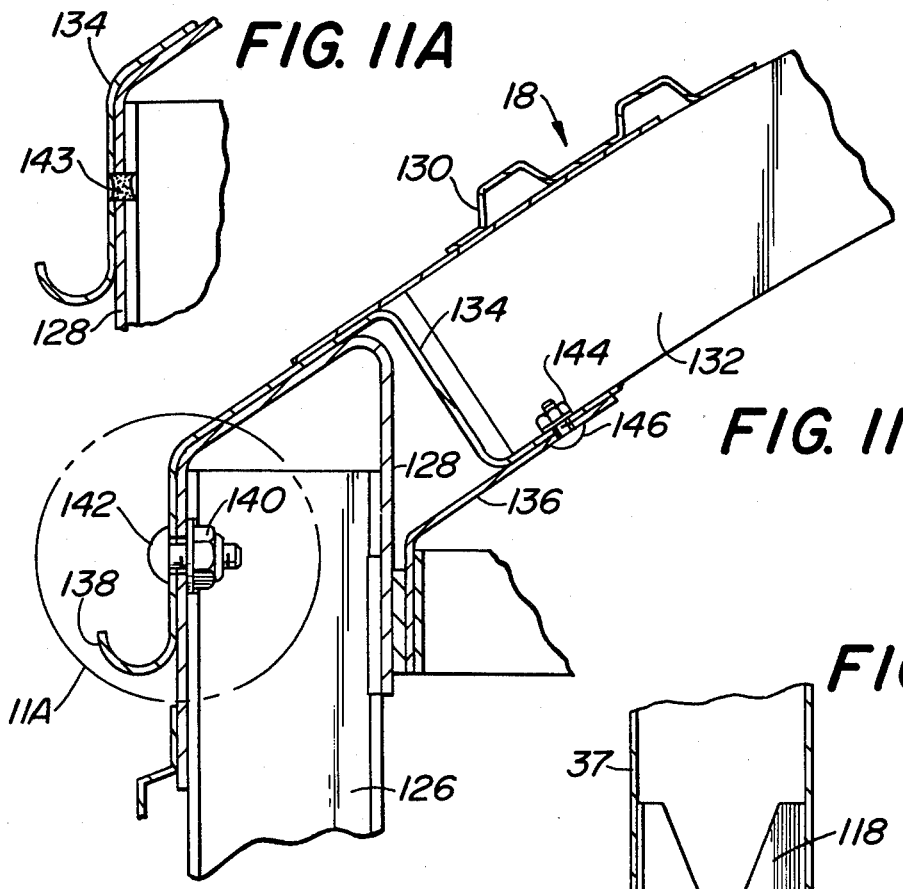
FIG. 11A
FIG. 11
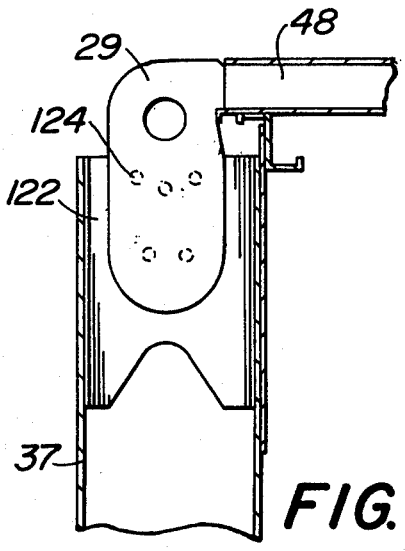
FIG. 10
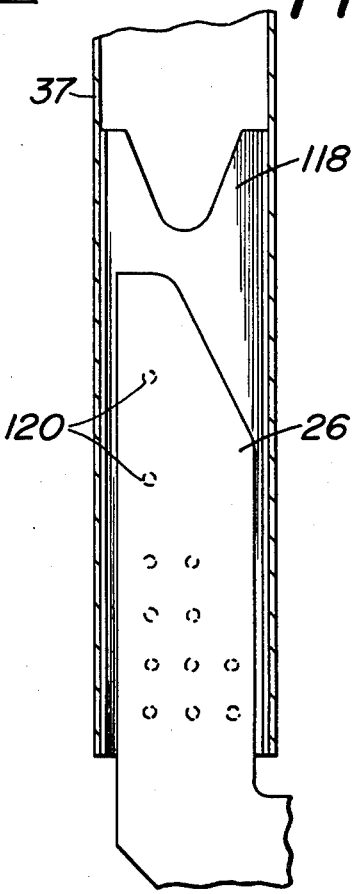
FIG. 9

MEANS FOR MANUFACTURING A MODULAR RAILWAY CAR

It is known to construct separate components of railway cars before interconnecting them to form a car body. For example, the roof panel, side panels, floors and roof may be separately fabricated before assembly. Generally the components are welded together but sometimes they are bolted together, as illustrated, for example, in a patent to W. S. Eggert Jr., U.S. Pat. No. 3,131,649.

One of the main costs in the construction of railway cars relates to the labor involved in assembly. In railway cars of the type illustrated in the aforementioned patent, the individual components may be packaged and shipped while separated. They may be then assembled by bolting the individual components together. Such bolting, while requiring care, does not require as high a degree of skill as welding.

Such so called "knock down" cars have special appeals dependent upon the particular customers involved, particularly from a cost point of view. For example, where highly skilled help is in short supply, bolting of the components may be desired. On the other hand, some customers may wish to weld the components together by conventional welding means and utilize local labor for assembly rather than that of the manufacturer's. If mass production techniques are to be employed in order to keep the costs of manufacture of components to a minimum, it is desirable that the basic components manufactured be capable of being assembled by either bolting or welding. Also, it is desirable that the basic car be capable of complying with other requirements, such as providing cars of different lengths, without changing the basic structural components.

Another major cost factor involving the assembly of "knock down" railway cars relates to the packaging and unpackaging of the individual components. Heretofore, all the main components were packed in a closed container and shipped. Generally, the container was relatively large occupying much cubic footage which added to the cost of shipping. At the point of destination, the individual components were separately removed from the container. The floor component, after removal from the container, was placed on a fixture or jig generally adjacent a pair of tracks. The other components were then connected thereto with the trucks finally being moved beneath the completed railway car body.

The procedure for packing and unpacking used heretofore is time consuming and costly because of the excessive handling required to remove the components from the package and assemble them in place on the fixture. Also, the cost of shipping an assembled railway car is much higher than shipping the components therefor in a package.

It is an object of this invention to provide improved means and methods for making a modular railway car which may be readily shipped and assembled by relatively unskilled labor.

It is a further object of this invention to provide an improved railway car which may be assembled by either bolting or welding the components together.

It is still a further object of this invention to provide an improved railway car which may be manufactured in different lengths with a minimum number of structural changes in the components involved.

It is still a further object of this invention to provide improved means and methods for packing and unpacking a modular railway car wherein a minimum amount of space is occupied to reduce the shipping space required.

In accordance with the present invention, modular railway car components are adapted to be built in different lengths. A pair of sideframes are built in integral sections having a plurality of uniformly spaced windows with the spacing between windows corresponding to the length of one of said sections. A floor includes a plurality of uniformly spaced transverse floor beams with the distance between a predetermined number of floor beams corresponding to the length of one of the sections. A roof includes a plurality of uniformly spaced transverse roof beams with the distance between a predetermined number of roof beams also corresponding to the length of one of the sections. The sideframes, floor and roof are connected together and to the end frame assemblies. The components may be built in different section lengths to provide a railway car of different lengths without major structural design changes.

Other objects and advantages of the present invention will be apparent and suggest themselves to those skilled in the art, from a reading of the following specification and claims taken in conjunction with the accompanying drawings, in which:

FIG. 6 is a side view of one end of the completed railway car;

FIG. 7 is an end view of the completed railway car;

Figure 8:
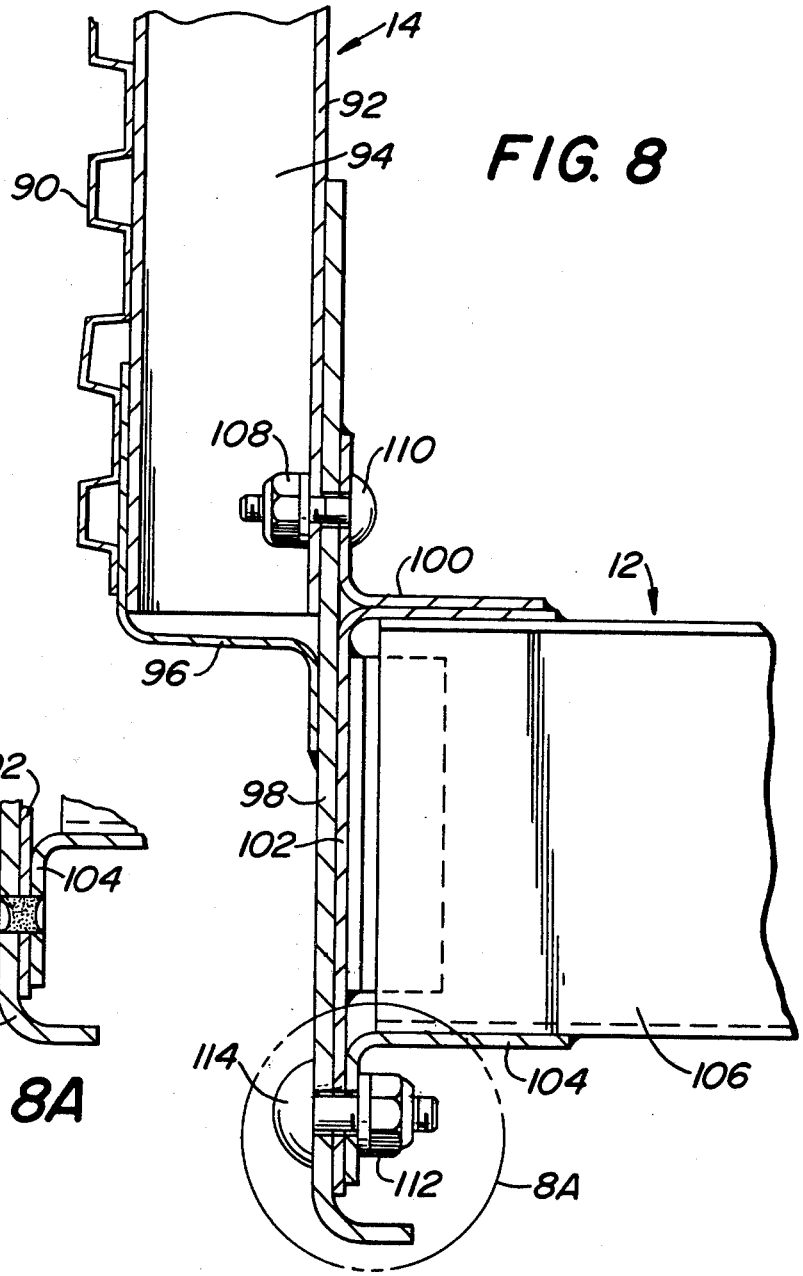
FIG. 8 is a cross-sectional view taken along lines 8—8 of FIG. 6 illustrating the means for connecting the sidewalls to the floor of the railway car by bolting.
Figure 8A:
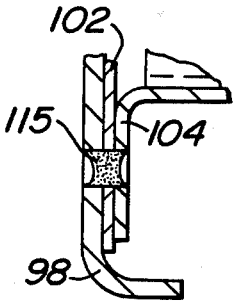

FIG. 8*a* is a section 8A of FIG. 8 illustrating the connection of the parts by welding;

FIG. 9 is a cross-sectional view taken along lines 9—9 of FIG. 7 illustrating the means for connecting the floor to the end frames of the railway car;

FIG. 10 is a cross-sectional view taken along lines 10—10 of FIG. 7 illustrating the connections of the roof to the end frames of the railway car;

FIG. 11 is a cross-sectional view taken along lines 11—11 of FIG. 7 illustrating the bolting of the roof to the side frames, and FIG. 11*a* is a section 11*a* of FIG. 11 illustrating a method of welding instead of bolting.

Figure 1:
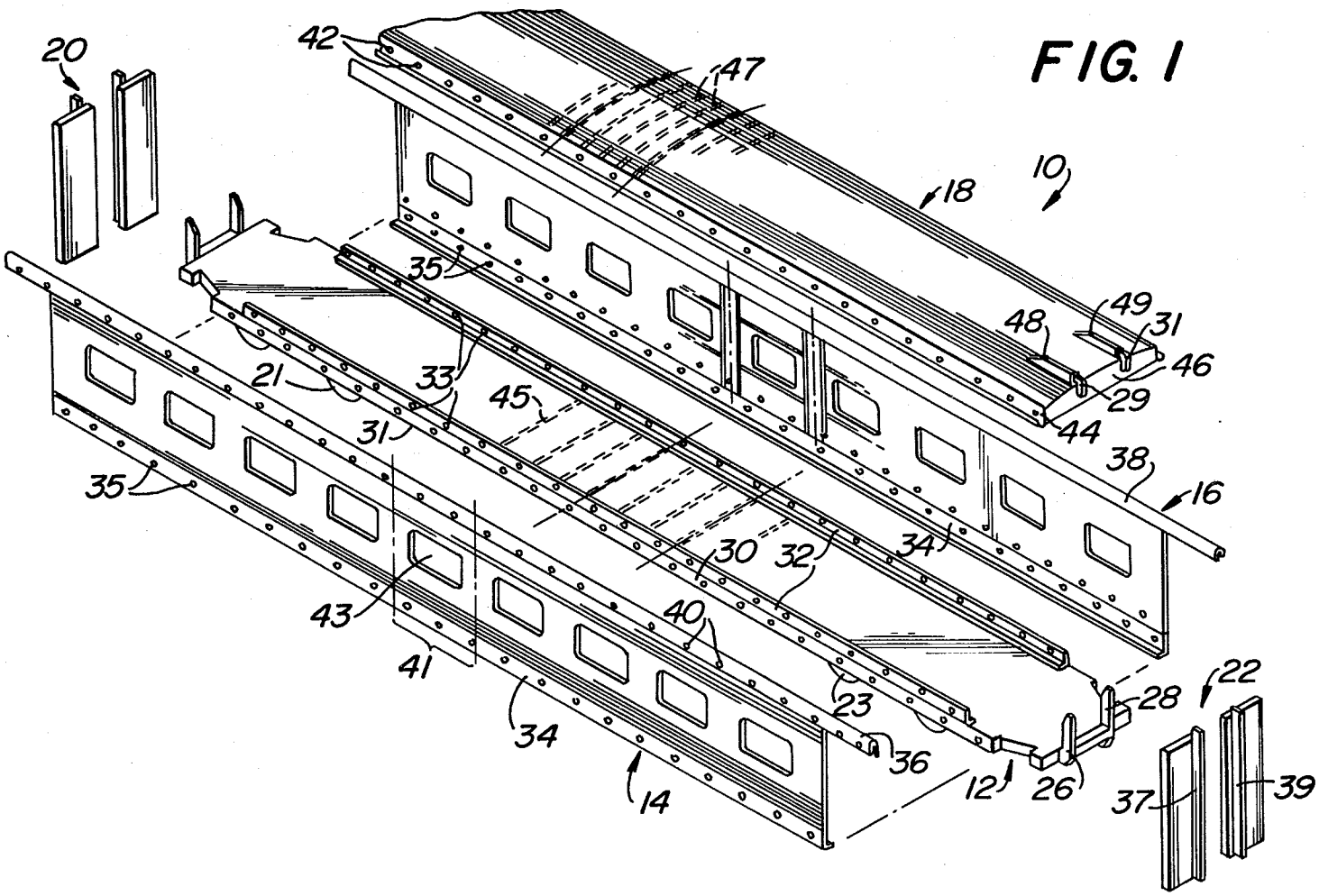
FIG. 1 is an exploded view illustrating the main components of a railway car, in accordance with the present invention.

Referring particularly to FIG. 1, a modular railway car 10 comprises a plurality of components including a floor 12, a pair of side frames or sidewalls 14 and 16, a roof 18, and a pair of end frame assemblies 20 and 22. These are the basic components which are manufactured in the factory and adapted to be packaged and shipped to a destination, where they are assembled.

Other smaller parts, such as the doors are not illustrated, and normally would be packaged with the main components illustrated. Trucks 21 and 23 would normally, but not necessarily, be packaged separately.

The floor 12 comprises end underframes 24 each having a pair of lugs 26 and 28 connected thereto. Both ends and sides of the floor are substantially similar and are therefore sometimes given the same reference numerals. The floor 12 includes longitudinal side sills 30 and 32 which are used as tie members connected to the floor by welding or otherwise on both sides and adapted to be connected to the side edges of the sideframes 14 and 16. In some cases, only a single tie may be required. The side sills 30 and 32 may include apertures 31 and 33.

The sideframes 14 and 16 each include a side sill 34 having a plurality of openings 35 adapted to receive bolts therethrough when they are connected through openings 35 and the openings 33 in the tie member 30 of the floor. The sideframes 14 and 16 include longitudinally extending top rails 36 and 38, respectively. The top rails 36 and 38 include apertures 40 adapted to receive bolts which also pass into openings 42 in the top rails of the roof 18. Portions of the top rails 36 and 38 extend beyond the sideframes 14 and 16 on both ends to accommodate end door openings for the car.

The roof 18 includes roof rails 44 on both sides including the aligned openings 42. A bulk head sheet 46 is provided at both ends of the rail Purlins 48 and 49 are provided at both ends of the roof and include a pair of lugs 29 and 31. The lugs 29 and 31 provide means for connecting the roof to the collision posts 37 and 39, respectively, which are included in the end frame assemblies 20 and 22. While various other smaller parts, such as doors and the like, involved in the railway car are not illustrated, the components illustrated in FIG. 1 along with the trucks normally comprise the main parts which are shipped to a destination.

A feature of the car 10 is that it may be constructed in different lengths without changing the basic structural design. For example, sections of the car may be of any desired length, for example, 63 inches, as illustrated by a secion 41. Each window 43 may be spaced from each adjacent window by 63 inches or desired length. Floor beams 45 may be spaced 21 inches apart, the carlines 76 may be spaced $15\frac{3}{4}$ inches apart. Of course, the spacing may vary and be in any sub-multiple of the section. The car 10 may be made shorter or longer by increasing or decreasing the number of sections 41, which may be considered a window module with appropriate modifications of the floor and roof.

Figure 3:
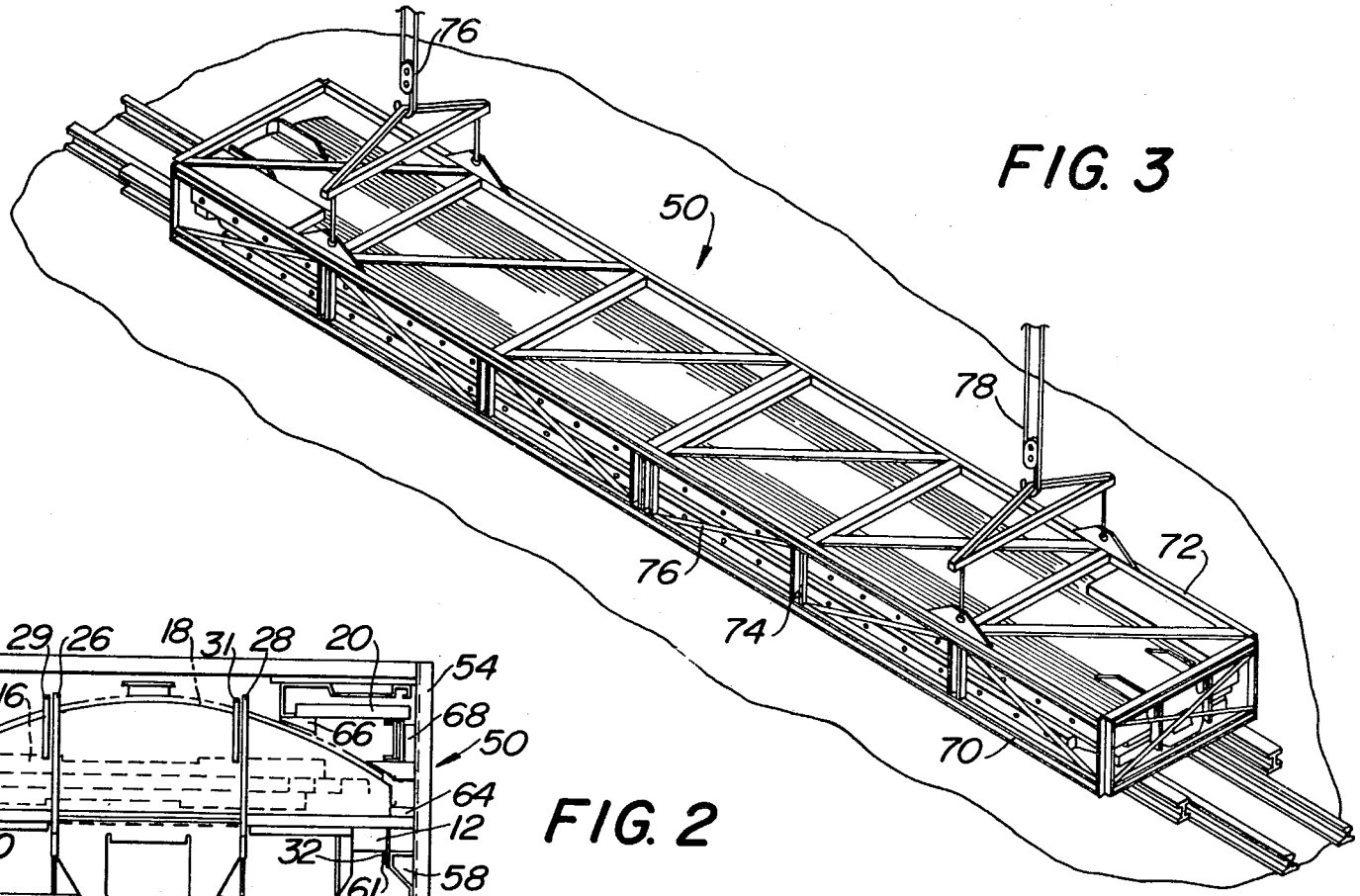
FIG. 3 is an isometric view of the railway car components of FIG. 1 in a container after shipment as it is placed on a jig or fixture at the point of destination.
Figure 2:
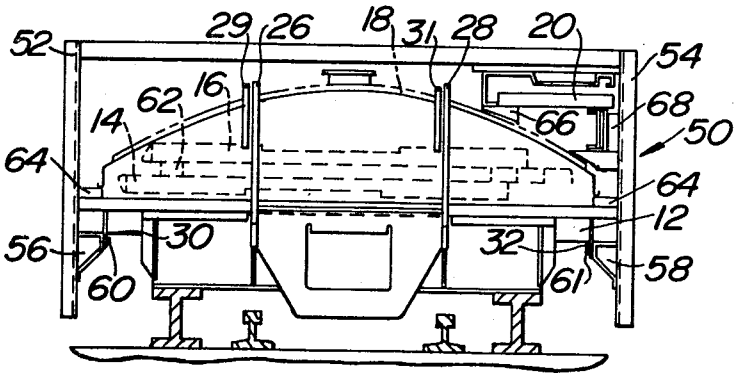
FIG. 2 is an end view of the components of the railway car in the container.

Referring particularly to FIGS. 2 and 3, a method and means for packaging the components of FIG. 1 is illustrated. The means for packaging the components comprises an open bottom container 50. The container comprises a metal frame having suitable vertical and horizontal posts with cross beams to provide strength. The open bottom is provided so that the entire package with the components therein may be placed over a fixture or jig at the point of destination. When the package 50 is placed over the fixture or jig, the floor will be in place and a minimum movement of the other components are involved in assembling the car body. It is important that the floor be fully supported until other structural members are added.

The container 50 includes a pair of sideframe trusses 52 and 54. The trusses include a pair of rail members 56 and 58 attached longitudinally thereon. The floor 12 has its bottom tie 30, 32 bolted to the side rails 56 and 58, respectively. Bolt 60 and 61 connect the tie 30 to the side rails 56 and 58, respectively. If the floor is made for a welding operation, other means for holding the floor secured to the side rails must be provided. With the floor secured to the side rails of the open bottom container 50, the other modular components of the rail car 10 may then be put into the container for shipment. The sideframes 14, 16 are first placed on the floor 12 with a spacer beam elements 62 therebetween. The roof 18 is then placed within the container on a pair of longitudinally extending side beams 64. Next, the end side frame assemblies 20 and 22 may be placed on top of the roof with suitable spacer elements 66 and 68 placed therebetween. Sometimes it may be desirable to place the end frames under the roof. It is noted that provisions are made for the collision posts lugs 26 and 28 and for the collision lugs 29 and 31 for the roof.

In FIG. 3, the various components illustrated in FIGS. 1 and 2 are illustrated within the open bottom container 50 after shipment and placement on the fixture or jig at the point of destination. The container 50 comprises a pair of longitudinally extending bottom and top beams 70 and 72 on each side. A pluraltiy of vertical beams 74 connect the top to the bottom beams on both sides. A plurality of diagonally disposed beams 76 connect the corners formed by the beams 70 and 72 and 74. The entire assembly includes metal beams strong enough to support the weight of the car body components. The complete assembly is adapted to be lifted by a pair of cranes 76 and 78 well known to those skilled in the art. The entire container 50 with the components may be transported from the factory to a ship or train and finally to its point of destination where the car is to be assembled.

After the railway car within the container is shipped to its destination, the entire open bottom container 50 with the modular components therein are placed on a fixture or jig generally disposed close to a pair of railway tracks. The car is then assembled at this point. Because of the arrangement in packing, most of the components are already in place. For example, the floor 14 may be placed directly on the jig. After removal of the roof 18 and end frame assemblies 20 and 22, the sidewalls 14 and 16 are raised and then bolted or welded to the floor, as will be illustrated in subsequent figures. After the sideframes are in place, end frames 20 and 22 are then put in place and the roof finally assembled onto the sideframes and end frames to complete the basic assembly of the car. Removal of all the individual pieces from the container before starting the assembly is avoided by the arrangement illustrated. All the parts needed to be assembled are close to the point of assembly with the roof and end frames comprising the major component which has to be removed from the container to permit the raising of the sideframes.

Figure 4:
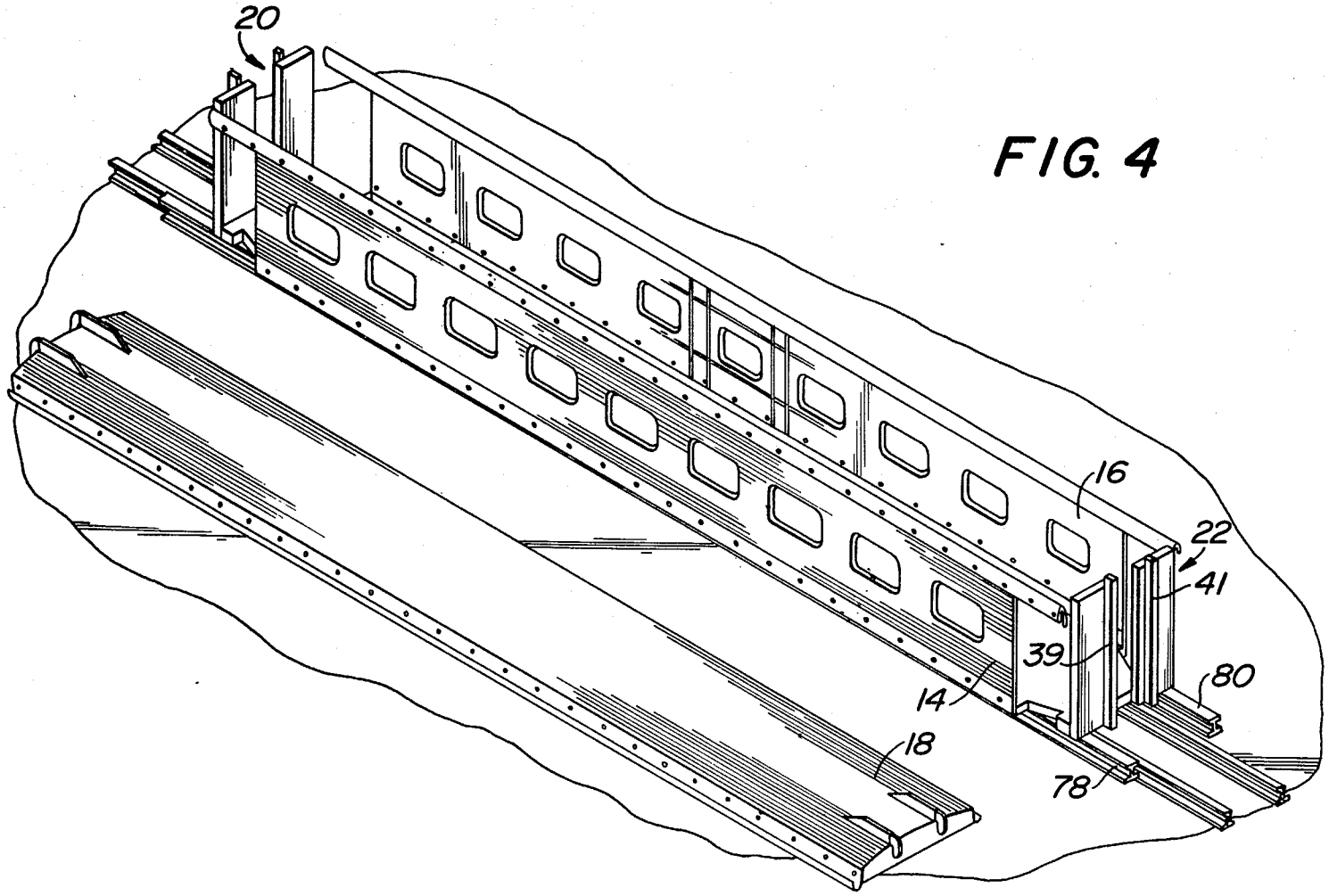
FIG. 4 is an isometric view of the components of a railway car after unpacking and partial assembly.

Referring particularly to FIG. 4 a partly assembled rail car is illustrated on a fixture or jig illustrated as being beams 78 and 80. It is understood that the jig may comprise elements other than beams and may be of a more complex design capable of supporting different parts of the car. The car is illustrated with the open bottom container 50 completely removed. As previously mentioned, the roof 18 is generally unpacked first and put aside until the sideframes 14 and 16, along with the end frame assemblies 20 and 22 are secured in place. The end frames 20 and 22 are attached to the collision post lugs 26 and 28 extending from the floor 12 (FIG. 1) by means of bolting or welding.

Figure 5:
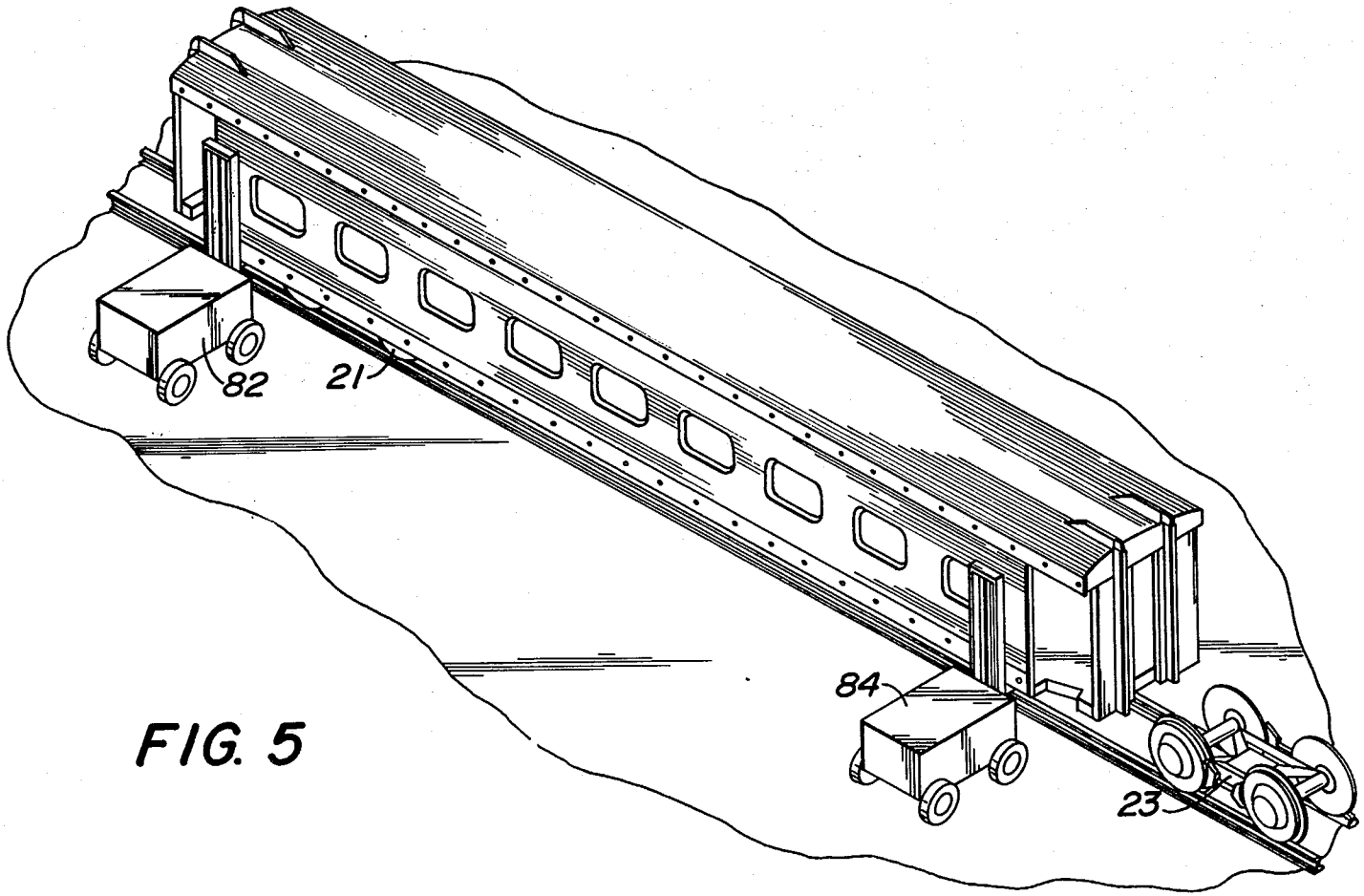
FIG. 5 is an isometric view of the completely assembled railway car with one truck in place with the second truck ready to be put in place.

Referring particularly to FIG. 5, the car in its completed form is illustrated. On completion of the car, it is lifted from the jig by lift truck 82 and 84 and the pair of trucks 21 and 23 are positioned beneath the car and secured thereto.

By way of example only, the sequence of unpacking and assembling the car body 10 as illustrated in FIGS. 3, 4 and 5 comprises the following steps:

1. Placing the container 10 with the modular components contained therein onto the jigs 78 and 80.
2. Removing the top portion of the container
3. Removing the end frames 20 and 22.
4. Removing the roof 18.
5. Removing remainder of container 50.
6. Lifting and attaching the sideframes 14 and 16 to the floor 12 in one of the ways illustrated in FIG. 8 or FIG. 8A.
7. Inserting and attaching the end frame assemblies 20 and 22 into the floor lugs 26 and 28 are illustrated in FIG. 9.
8. Attaching the roof 18 by bolting or welding as illustrated in FIGS. 10, 11 and 11*a*.
9. Installing the doors and other necessary parts.
10. Placing the trucks beneath the car body and securing the tracks to the car body.

It is understood that the order of some of the steps listed above may sometimes vary. However, the floor must be on the bottom with the roof towards the top.

Referring particularly to FIGS. 6 and 7, a side view of one end of the finished car is illustrated in FIG. 6 with the end of the car being illustrated in FIG. 7. Various elements, not previously illustrated are illustrated in these figures. For example, side doors 86 are illustrated installed below the extending roof rails. Also end doors 88 are provided at the ends of both cars. The various components related to the trucks 21 and 23 are illustrated in the truck 23. As is conventional, the trucks normally include wheel and axle assemblies, braking mechanisms, and bolsters for supporting the car body.

Referring particularly to FIG. 8, there is illustrated a means of assembling the sideframe 14 to the floor 12. The sideframe 14 includes an outer wall 90, which may be corrugated, to the main structure 92 sideframe 14. The sideframe 14 includes a plurality of vertical posts, such as a post 94. The posts 94 are spaced at predetermined spacings, as for example 21 inches to permit different lengths of the sideframe 14. A Z-member 96, while forming part of the sideframe 14, connects the wall 90 to the side sill 98. It may be seen that the total sideframe 14 as illustrated in FIG. 1, comprises the outer wall 90, the main sideframe 92, the post 94, the Z-member 96 and the side sill 98.

The sideframe member comprises a post tie 100, floor angle 102, a floor angle 104 for supporting the floor, a plurality of floor beams comprising the floor pan such as the floor beam 106, and a connection member 108 which connects the floor beam 106 and the floor angle 102.

A threaded bolt 110 is connected through apertures in the tie post 100 (which is shown as the post 32 in FIG. 1), side sill 98 and post 94 and held in place by a nut 108. Likewise, a threaded bolt 114 is connected through apertures in the floor angle 104, floor angle 102 (which is the post 30 of FIG. 1) and the side sill 98 and held in place by a nut 112. It may be seen from FIG. 8 that when the sideframes are raised in place, they may be bolted together through the various aligned apertures in the ties 30 of the sideframes 14 and 16 and floor members as illustrated in FIG. 1. The connections may be by means for a nut and bolt connection illustrated or may be by means of welding.

Referring to FIG. 8A, if it is desired to weld the side frame structure to the floor rather than bolt them together, the apertures in the ties and side sills are omitted during the manufacturing operation. The areas requiring welding are readily accessible and are sufficiently large to receive the weld joints. Weld joints 115 illustrates the side sills 98 welded to the floor angles 102 and 104. It may be seen that the car 10 is capable of being readily bolted together or welded together depending upon the particular conditions existing and the desires of a customer.

Referring particularly to FIG. 9, the tie lugs 26 and 28 from the end frame are connected to collision posts 37 and 39 of which only one post 37 and one lug 26 is illustrated in FIG. 9. A tie member 118 is secured by welding or otherwise to the interior of the collision post 37 for additional strength. After the collision post 116 is secured over the lug 26, they may be secured in place by a plurality of bolts 120, which are held in place by suitable nuts, not illustrated. Again welding may be employed.

After the side walls 14 and 16 with the end frames 20 and 22 have been erected and secured together, the roof 18 is raised and put in place.

Referring particularly to FIGS. 10 and 11, the collision post lugs 29 and 31 secured to the purlines 48 and 49, with only one lug 29 and purline 48 being illustrated in FIG. 11, are inserted into the collision posts such as the one post 37. A top tie member 122 is secured to the interior of the collision post for additional strength. The lug 29 is held securely to the collision post 37 by means for bolts 124 held in place by suitable nuts not illustrated.

The vertical post of the sideframes, of which only one post 126 is illustrated, are disposed to receive the top side rail 128. The roof 18 comprises top roof corrugations 130, a series of carlines 132 which may be curved, roof rail 134 and a time member 136. A drain element 138 is provided as part of the roof structure. A nut 140 and bolt 142 assembly passes through the post 126 and the top rail 128. In addition, a nut 144 and bolt 146 assembly may also connect the tie member 136 to the roof rail 134 when required for structural purposes. Thus it is seen that the roof may be readily bolted to the sidewalls and end frames. Referring to FIG. 11*a*, it is seen that the roof 14 may be welded to the side frames instead of bolted. Sufficient accessible areas are made available during manufacture to that either the bolting or welding method of assembly may be employed.

In FIG. 11*a*, a weld joint 143 replaces the nut 140 and bolt 142 arrangement illustrated in FIG. 11. The weld joint 143 connects top rail 128 of the sideframe to the roof rail 134.

While a particular embodiment has been illustrated, it is recognized that the various components may taken different forms than those shown. In general, the invention is directed to components which may be bolted or welded together, which may be compactly packaged and which may be built in different lengths.

What is claimed is:

1. Modular railway car components adapted to be built in different lengths comprising:

a pair of sideframes built in integral sections having a plurality of uniformly spaced windows with the spacing between windows corresponding to the length of one of said sections, side sills along the lower edge of the sideframe extending the entire length of the sideframe and top rails along the upper edge of each sideframe extending beyond the ends of the sideframes, a floor having a plurality of uniformly spaced transverse floor beams with the distance between a predetermined number of floor beams corresponding to the length of said one section, and floor sills extending the entire length of said floor adapted to cooperate with said sideframe side sills, a roof having a plurality of uniformly spaced transverse roof beams with the distance between a predetermined number of said roof beams corresponding to the length of said one section, and roof rails along each side of said roof extending the entire length of said roof and adapted to cooperate with said top rails, a pair of end frame assemblies, and means for connecting said side frames and end frame assemblies to said floor and said roof to said side frames and said end frame assemblies.

2. A railway car as set forth in claim 1 wherein said floor sills, side sills, top rails and roof rails include areas dimensioned to receive weld joints to provide said means for connecting.

3. A railway car as set forth in claim 2 wherein said components include apertures and said means for connecting comprises nuts and bolts for connecting said components to form said railway car.

4. A railway car as set forth in claim 1 wherein said sections include one window, three floor beams and four roof beams.

5. A railway car as set forth in claim 1 wherein said floor sills, side sills, top rails and roof rails include areas dimensioned to receive bolts to provide said means for connecting.

* * * * *